US009828857B2

(12) United States Patent
Huxol et al.

(10) Patent No.: US 9,828,857 B2
(45) Date of Patent: Nov. 28, 2017

(54) REPAIRED OR REMANUFACTURED BLADE PLATFORM FOR A GAS TURBINE ENGINE

(71) Applicant: PW Power Systems, Inc., Glastonbury, CT (US)

(72) Inventors: Jason Huxol, Hondo, TX (US); Jayson Houston, San Antonio, TX (US); Mark Towner, Kenedy, TX (US); Leissner Ferdinand Poth, III, San Antonio, TX (US)

(73) Assignee: PW POWER SYSTEMS, INC., Glastonbury, CT (US)

( * ) Notice: Subject to any disclaimer, the term of this patent is extended or adjusted under 35 U.S.C. 154(b) by 564 days.

(21) Appl. No.: 14/482,303

(22) Filed: Sep. 10, 2014

(65) Prior Publication Data

US 2016/0069196 A1 Mar. 10, 2016

(51) Int. Cl.
*F01D 5/30* (2006.01)
*F01D 5/00* (2006.01)

(52) U.S. Cl.
CPC ..... *F01D 5/005* (2013.01); *F05D 2230/237* (2013.01); *F05D 2240/80* (2013.01); *F05D 2250/74* (2013.01)

(58) Field of Classification Search
CPC .. F01D 5/005; F05D 2240/80; F05D 2250/74; F05D 2230/237
See application file for complete search history.

(56) References Cited

U.S. PATENT DOCUMENTS

| | | | |
|---|---|---|---|
| 5,134,774 | A | 8/1992 | Porter |
| 5,261,480 | A | 11/1993 | Wortmann et al. |
| 5,895,205 | A | 4/1999 | Werner et al. |
| 6,199,746 | B1 | 3/2001 | Dupree et al. |
| 6,508,000 | B2 | 1/2003 | Burke et al. |
| 6,908,288 | B2 | 6/2005 | Jackson et al. |
| 7,449,658 | B2 | 11/2008 | Mielke |
| 7,648,341 | B2 | 1/2010 | Lau |
| 2003/0034379 | A1 | 2/2003 | Jackson et al. |
| 2008/0267775 | A1 | 10/2008 | Grady et al. |
| 2009/0060714 | A1 | 3/2009 | Moors |

FOREIGN PATENT DOCUMENTS

| | | | |
|---|---|---|---|
| EP | 1940581 | A1 | 7/2008 |
| EP | 2317075 | A2 | 5/2011 |
| EP | 2361720 | A1 | 8/2011 |
| GB | 2095589 | A | 10/1982 |

*Primary Examiner* — Ryan J Walters

(74) *Attorney, Agent, or Firm* — Schwegman Lundberg & Woessner, P.A.

(57) ABSTRACT

A article of manufacture, the article having a nominal profile substantially in accordance with Cartesian coordinate values of X, Y and Z set forth in TABLE 1, and wherein X and Y are distances in inches which, when connected, define profile sections at each distance Z in inches to form a portion of a rotor blade.

20 Claims, 10 Drawing Sheets

REPAIRED OR REMANUFACTURED BLADE PLATFORM FOR A GAS TURBINE ENGINE

BACKGROUND

The present disclosure relates to a gas turbine engine and, more particularly, to a repair or remanufacture procedure for a component thereof.

Gas turbine engines generally include a gas generator with a compressor section to pressurize an airflow, a combustor section to burn a hydrocarbon fuel in the presence of the pressurized air, and a turbine section to extract energy from the resultant combustion gases. In an industrial gas turbine (IGT) engine, a core gas stream generated in the gas generator is passed through a power turbine section to produce mechanical work.

The core gas stream downstream of the combustor section may subject the turbine components to pressure gradients, temperature gradients, and vibrations that may result in thermal-mechanical fatigue cracks. Eventually, the turbine components may need to be replaced multiple times over the engine service life. Replacement of such components is relatively expensive such that there are often considerable economic incentives to repair these components.

SUMMARY

An article of manufacture according to one disclosed non-limiting embodiment of the present disclosure includes an article having a nominal profile substantially in accordance with Cartesian coordinate values of X, Y and Z set forth in TABLE 1, and wherein X and Y are distances in inches which, when connected, define profile sections at each distance Z in inches to form a portion of a rotor blade.

A further embodiment of the present disclosure includes a rotor blade platform puck and a portion of a platform.

A further embodiment of the present disclosure includes, an electrical discharge machined (EDM) platform puck is.

A further embodiment of the present disclosure includes a platform puck brazed to the platform.

A further embodiment of the present disclosure includes a platform puck and the portion of a platform within an envelope of +/−.0.160 inches in a direction normal to any article surface location.

A further embodiment of the present disclosure includes an article shape within an envelope of +/−.0.160 inches in a direction normal to any article surface location.

A further embodiment of the present disclosure includes scaling, by a constant, of the Cartesian coordinate values of X, Y and Z set forth in TABLE 1.

A rotor blade according to another disclosed non-limiting embodiment of the present disclosure includes having a nominal profile substantially in accordance with Cartesian coordinate values of X, Y and Z set forth in TABLE 1, and wherein X and Y are distances in inches which, when connected, define profile sections at each distance Z in inches to form a platform puck brazed to a portion of a platform.

A rotor blade according to another disclosed non-limiting embodiment of the present disclosure includes a nominal profile substantially in accordance with Cartesian coordinate values of X, Y and Z set forth in TABLE 1, and wherein X and Y are distances in inches which, when connected, define profile sections at each distance Z in inches define a repair assembly including a platform puck brazed to a portion of a platform, the Cartesian coordinate values of X, Y and Z set forth in TABLE 1 are scaled by a constant.

A further embodiment of the present disclosure includes a platform puck brazed to the platform only on a pressure side of the platform.

The foregoing features and elements may be combined in various combinations without exclusivity, unless expressly indicated otherwise. These features and elements as well as the operation of the invention will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
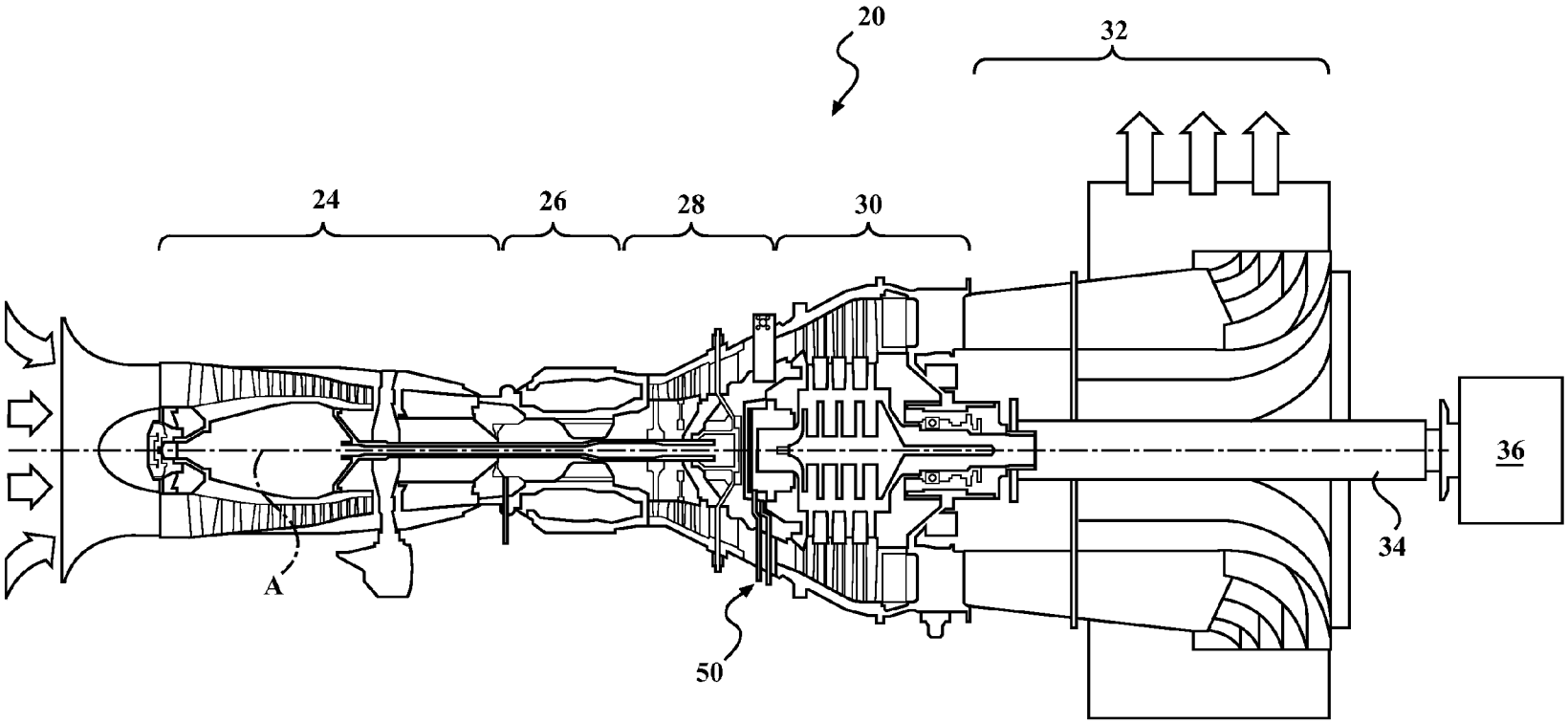
FIG. 1 is a schematic cross-section of an example gas turbine engine.
Figure 2:
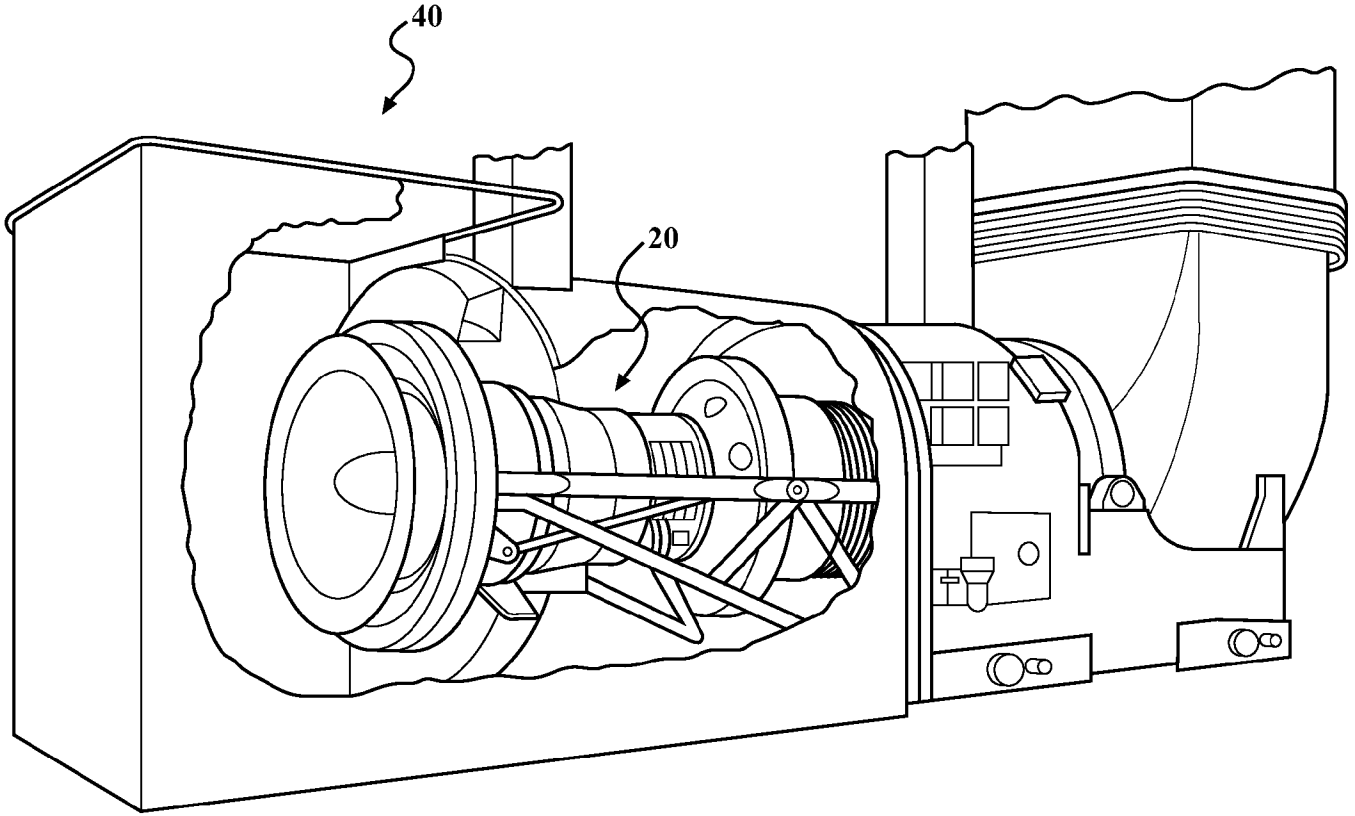
FIG. 2 is a schematic view of an example gas turbine engine in an industrial gas turbine environment.

FIG. 1 schematically illustrates a gas turbine engine 20. The gas turbine engine 20 generally includes a compressor section 24, a combustor section 26, a turbine section 28, a power turbine section 30, and an exhaust section 32. The engine 20 may be installed within a ground-mounted enclosure 40 (FIG. 2) typical of an industrial gas turbine (IGT). Although depicted as specific engine architecture in the disclosed non-limiting embodiment, it should be understood that the concepts described herein are not limited to only such architecture, as the teachings may be applied to other gas turbine architectures.

The compressor section 24, the combustor section 26, and the turbine section 28 are collectively referred to as a gas generator that is operable to drive the power turbine section 30. The power turbine section 30 drives an output shaft 34 to power a generator 36 or other system. In one disclosed non-limiting embodiment, the power turbine section 30 includes a free turbine with no physical connection between the gas generator and the power turbine section 30. The generated power is a thereby a result of mass flow capture by the otherwise free power turbine.

Figure 3:
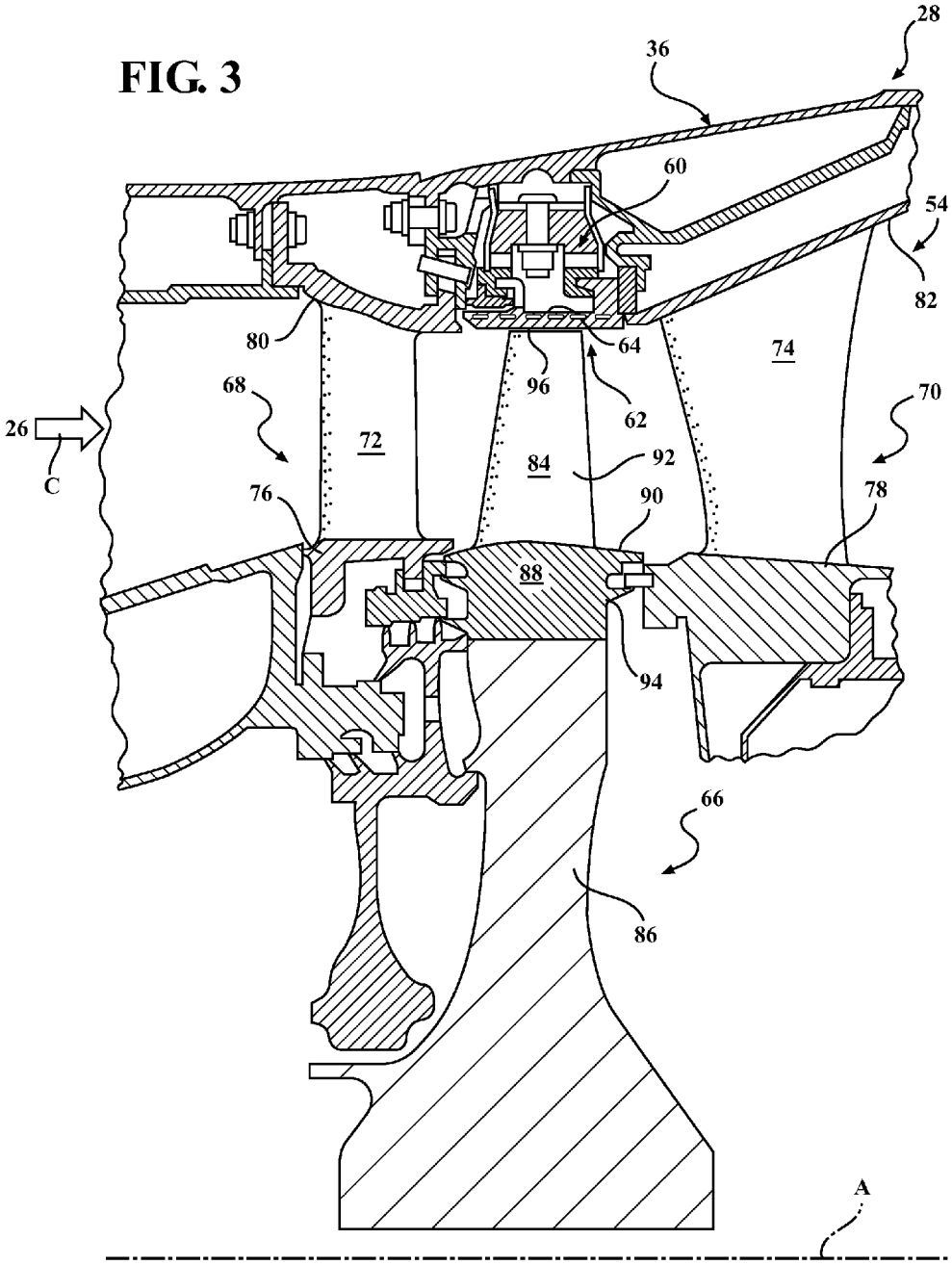
FIG. 3 is an enlarged schematic cross-section of a turbine section of the engine.

With reference to FIG. 3, an enlarged schematic view of a portion of the turbine section 28 is shown by way of example; however, other engine sections will also benefit herefrom. A full ring shroud assembly 60 mounted to an engine case structure 36 supports a Blade Outer Air Seal (BOAS) assembly 62 with a multiple of circumferentially distributed BOAS 64 proximate to a rotor assembly 66 (one schematically shown). The full ring shroud assembly 60 and the BOAS assembly 62 are axially disposed between a forward stationary vane ring 68 and an aft stationary vane ring 70. Each vane ring 68, 70 includes an array of vanes 72, 74 that extend between a respective inner vane platform 76, 78, and an outer vane platform 80, 82. The outer vane platforms 80, 82 are attached to the engine case structure 36.

Figure 4:
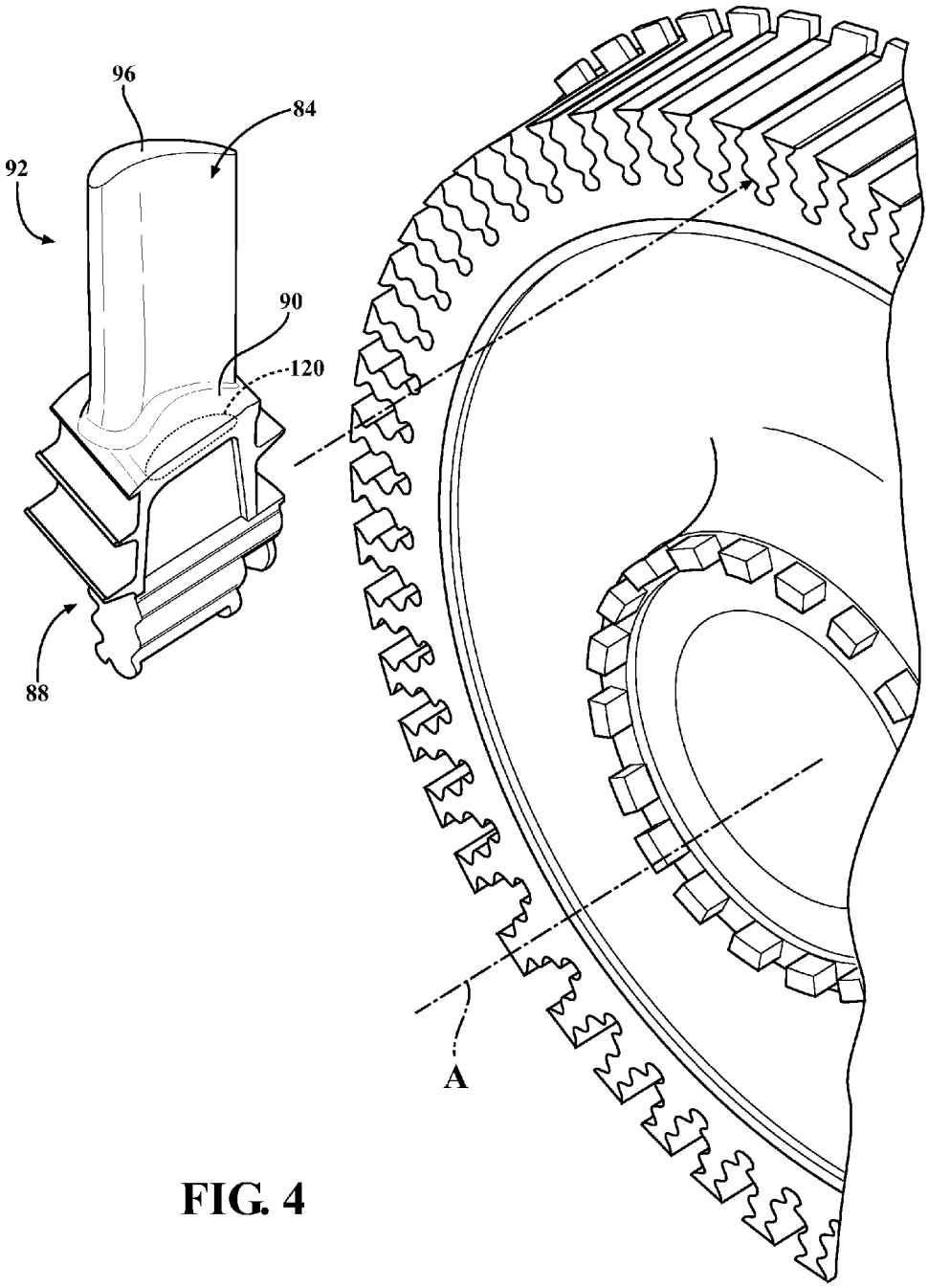
FIG. 4 is an enlarged perspective view of a turbine rotor and single representative rotor blade of the engine.

The rotor assembly 66 includes an array of blades 84 (one shown in FIG. 4) circumferentially disposed around a disk 86. Each blade 84 includes a root 88, a platform 90, and an airfoil 92. Each blade root 88 is received within a rim 94 of the disk 86 such that the airfoils 92 extend radially outward so that a tip 96 of each airfoil 92 is adjacent the BOAS assembly 62. The blades 84 are typically manufactured of, for example, a Nickel Alloy.

Combustion gases produced in the combustor section 26 (indicated schematically by arrow C) expand in the turbine section 28 and produce pressure gradients, temperature gradients, and vibrations. The turbine components in the turbine section 28 are thereby subject to thermal-mechanical fatigue that, over time, may generate cracks in these components.

Figure 5:
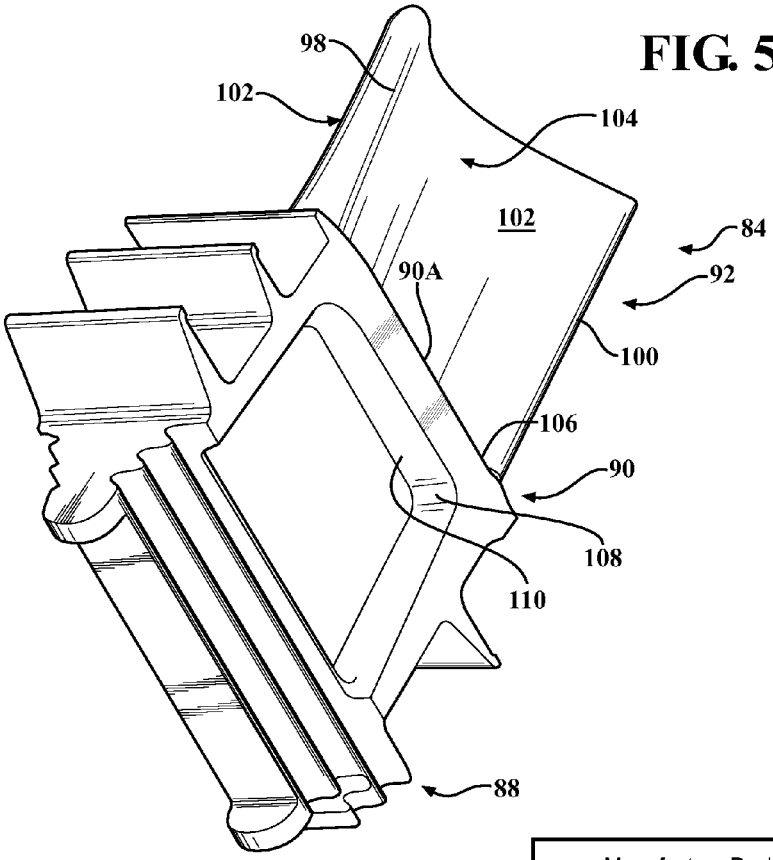
FIG. 5 is an expanded view of an underplatform region of the rotor blade.

With reference to FIG. 5, the platform 90 generally separates the root 88 and the airfoil 92 to define an inner boundary of the core gas path. The airfoil 92 defines a blade chord between a leading edge 98, which may include various forward and/or aft sweep configurations, and a trailing edge 100. A first airfoil sidewall 102 that may be convex to define a suction side, and a second airfoil sidewall 104 that may be concave to define a pressure side, are joined at the leading edge 98 and at the axially spaced trailing edge 100. The platform 90 includes a gas path surface 106 adjacent to the airfoil 92 and a non-gas path surface, also known as an undersurface 108 adjacent to the root 88. Here, the non-gas path side 108 of the platform 90 generally below the second airfoil sidewall 104 is referred to as the underplatform 110.

Thermal-mechanical fatigue cracks may occur on the underplatform 110 and can be removed via machining. This machining, however, thins the platform 90, and applicant has determined that the frequency and amplitude of occurrence of such cracks resulting from use subsequent to such machining is related to the thickness of the platform 90. The thickness of the platform 90, in an exemplary embodiment may range from about 0.100-0.200 inches (2.5-5.1 mm), depending in part upon casting and/or previous repairs.

Figure 6:
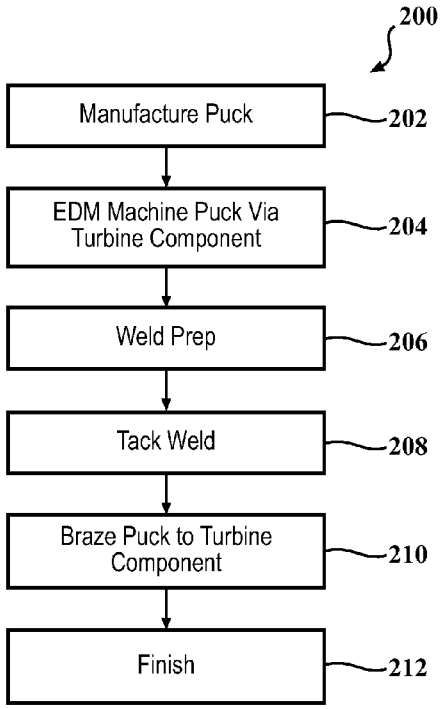
FIG. 6 is a flowchart illustrating a method to repair/remanufacture a platform of a turbine blade according to one disclosed non-limiting embodiment.
Figure 7:
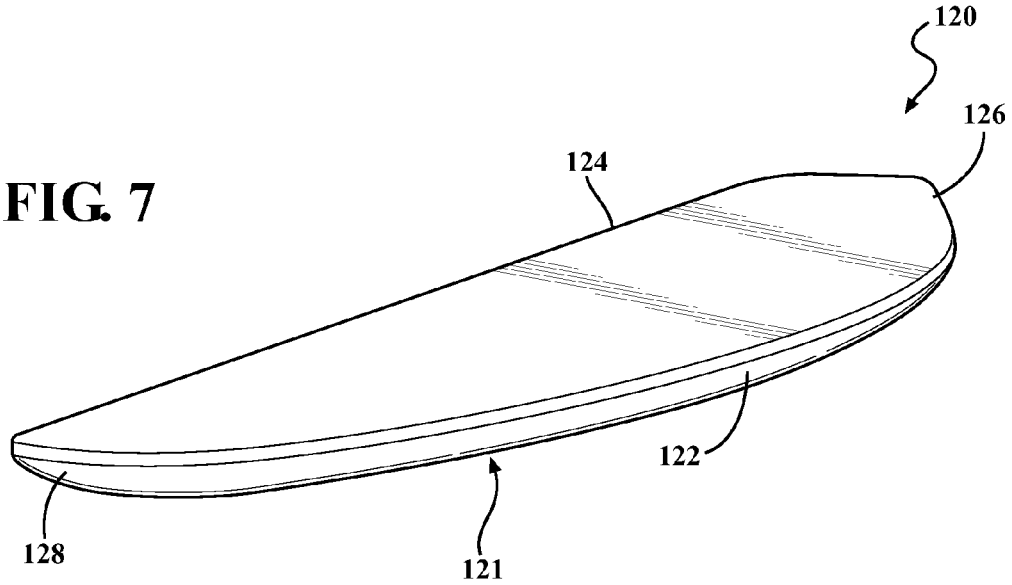
FIG. 7 is a perspective view of an example puck that is EDM and fastened to the turbine blade platform to increase the thickness thereof.

With reference to FIG. 6, one disclosed non-limiting embodiment of a repair method 200 initially includes manufacture of a puck 120 (FIG. 7; step 202). The puck 120 may be machined, cast, or otherwise manufactured from, for example, a superalloy with grains that will be aligned with the engine axis A. Alternatively, the puck 120 may be manufactured from braze presintered preform (PSP). Such initial manufacture provides a puck 120 with dimensions that are close to the underplatform pocket formed by blade 84.

Referring to FIG. 7, the puck 120, in this disclosed non-limiting embodiment, is generally semi-circular in shape with an arcuate side 122 that closely fits adjacent to the blade root 88 and a straight side 124 that generally aligns with an edge 90A (FIG. 5) of the platform 90. The puck 120 includes end sections 126, 128 that may be clipped or otherwise shaped for engagement within the underplatform 110 pocket of the non-gas path side 108. In this disclosed non-limiting embodiment, the puck 120 is has a thickness of about 0.030"-0.375" (0.762-9.525 mm).

With reference back to FIG. 6, next, the puck 120 is subject to Electrical discharge machining (EDM) (step 204). Electrical discharge machining (EDM) is a highly accurate method of machining metal materials in which material is removed from the workpiece by a series of rapidly recurring current discharges between two electrodes separated by a dielectric liquid, and subject to an electric voltage. One electrode is referred to as the tool-electrode, or simply, the 'tool,' while the other is referred to as the workpiece-electrode, or 'workpiece.' Generally, the 'tool' serves as a working electrode to facilitate removal of material from the 'workpiece'. Here, the polarity is reversed from normal EDM operation such that the blade 84 is the working electrode and the puck 120 is the machined part. That is, the underplatform 110 of the blade 84 (the 'tool'), electrical discharge machines the puck 120 (the 'workpiece').

The puck 120 is plunged into the underplatform 110 to remove material from the puck 120 until both parts create a near perfect fit one to another. Such a near perfect fit enhances braze strength, as it is desired for braze faying surfaces to have a gap no larger than about 0.005" (0.127 mm). That is, the puck 120 is initially cast and/or machined to be close to the dimension of the area of the underplatform 110, then subjected to the reverse EDM process to obtain a close-fitting gap therebetween. Trials have shown a finished gap of about 0.0005"-0.0045" (0.0127-0.1143 mm).

Next, the puck 120 and the underplatform 110 area are weld prepared (step 206). Weld preparation includes, but is not limited to, for example, degreasing, fluoride-ion cleaning, grit blast, hydrogen furnace clean, vacuum clean and/or others.

Next, the EDM machined platform puck 120 is located in the blade underplatform 110 pocket and tack welded thereto (step 208). It should be appreciated that various methods may be alternatively or additionally provided to affix the puck 120 to the underplatform 110 so as to facilitate brazing (step 210).

A braze slurry is then applied around a perimeter of the puck 120 and subsequently brazed via the application of heat to the blade 84, puck 120, and braze slurry (step 210). The braze slurry flows over and around the puck 120 to join the puck 120 to the underplatform 110. Since brazing does not melt the base metal of the joint, brazing allows much tighter control over tolerances and produces a clean joint with minimal, if any, need for secondary finishing. Additionally, dissimilar metals and non-metals (i.e. metalized ceramics) can be brazed. That is, the puck 120 may be manufactured of a material dissimilar to that of the blade 84.

The braze slurry is readily received into the close finished gap interface between the platform puck 120 and the underplatform 110 via capillary action to provide an effective braze therebetween. That is, the reverse EDM interface provides a close-fitting interface that facilitates a high strength brazed interface and does not further reduce the thickness of the platform 90.

Figure 8:
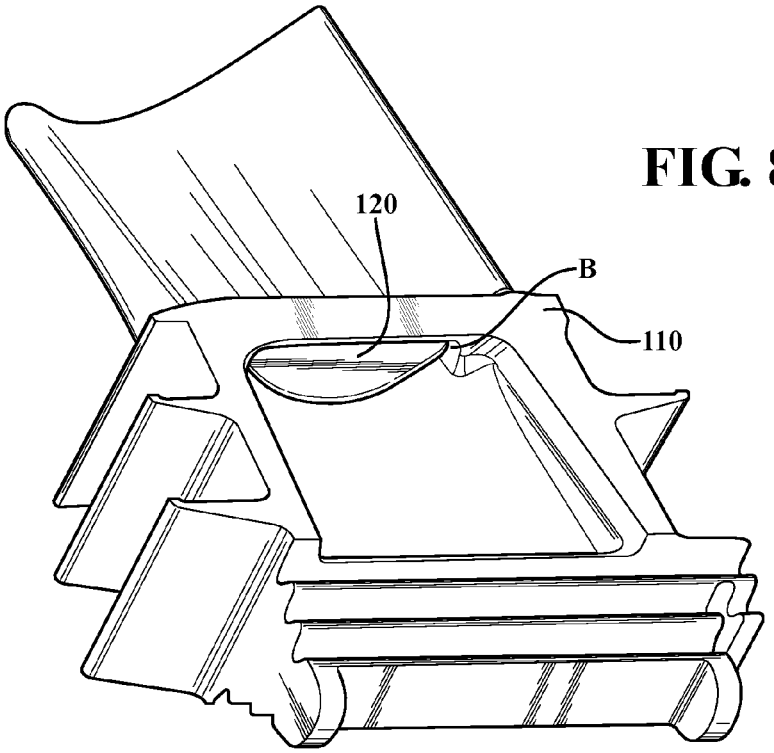
FIG. 8 is a perspective view of an underplatform region of the turbine blade with a puck according to one disclosed non-limiting embodiment.

Finally, the finished braze B may be blended and coated to form a desired profile (step 212; FIG. 8). The blend may be performed by hand and/or by machine operations.

Figure 9:
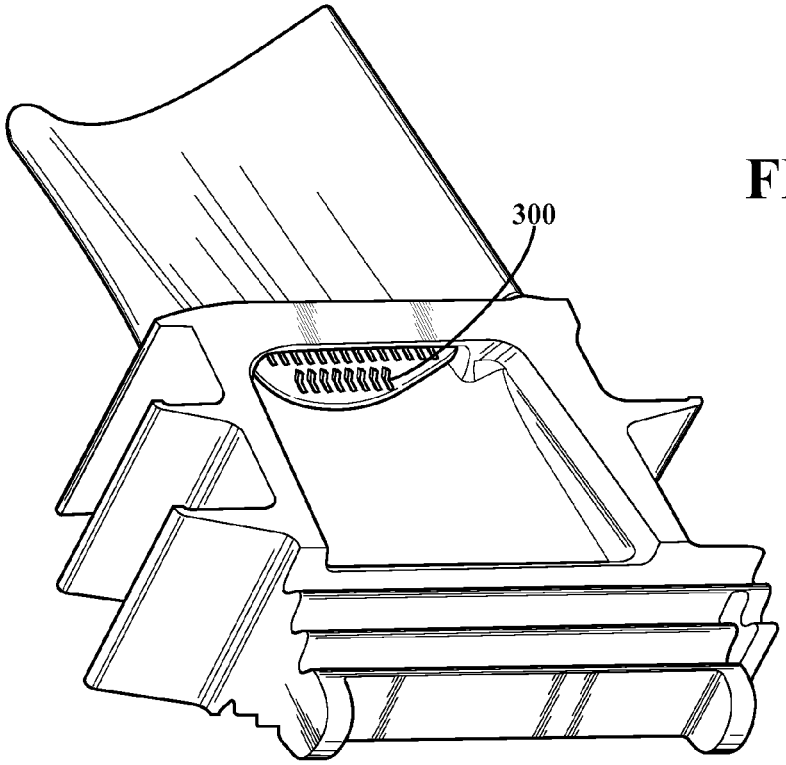
FIG. 9 is a perspective view of an underplatform region of the turbine blade with a puck according to another disclosed non-limiting embodiment.
Figure 10:
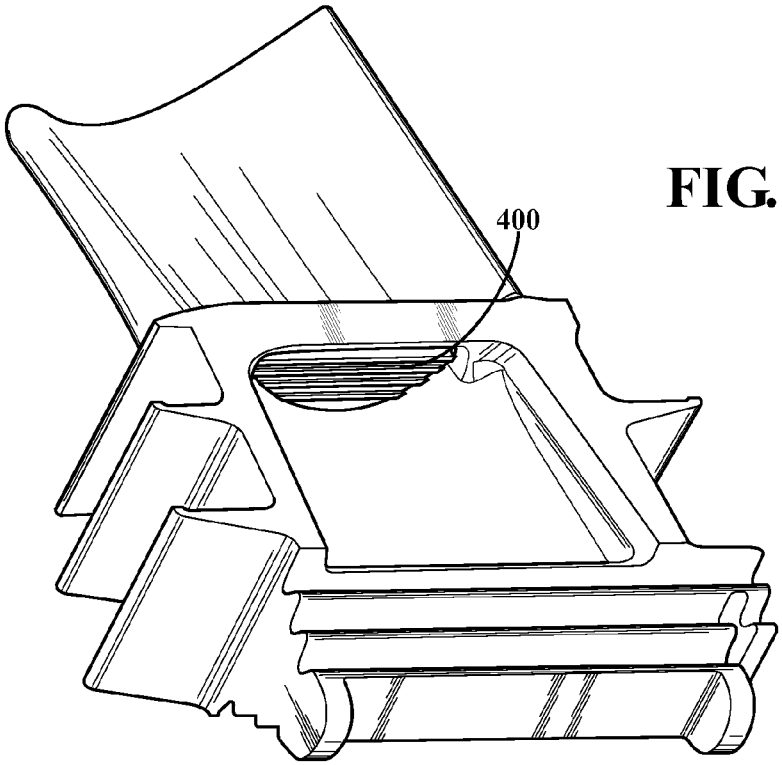
FIG. 10 is a perspective view of an underplatform region of the turbine blade with a puck according to another disclosed non-limiting embodiment.
Figure 11:
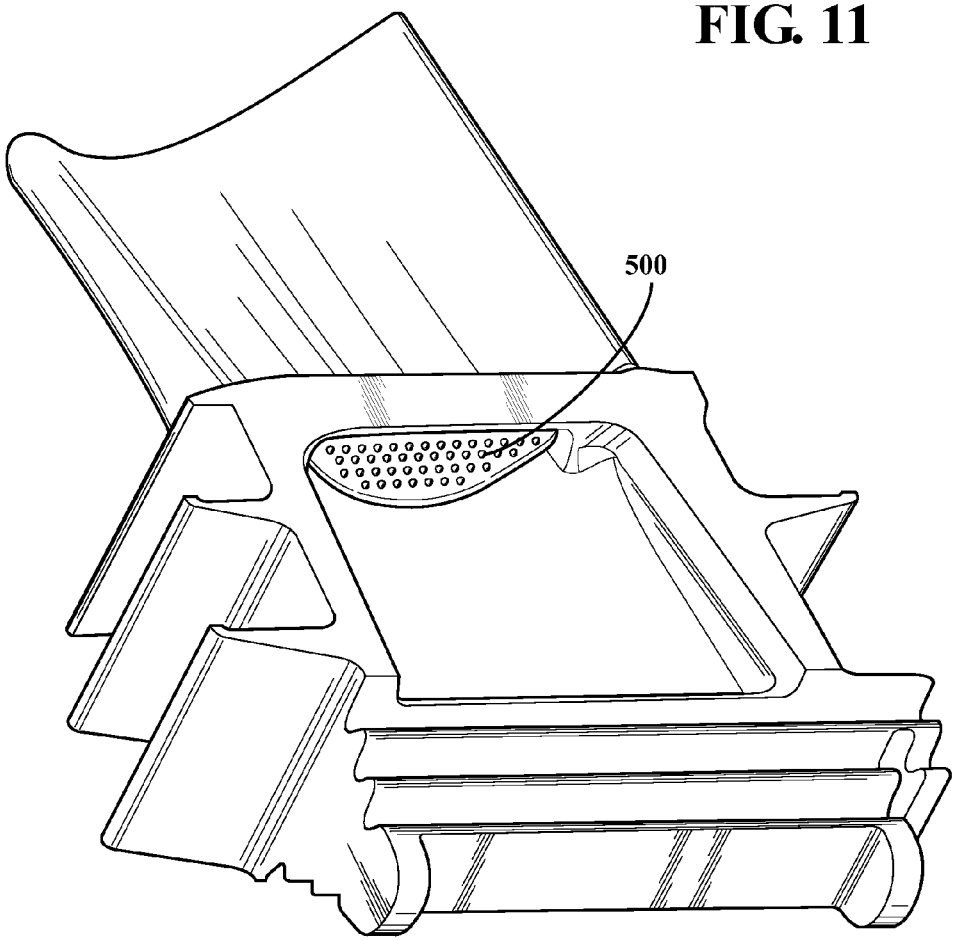
FIG. 11 is a perspective view of an underplatform region of the turbine blade with a puck according to another disclosed non-limiting embodiment.

With reference to FIG. 9, the platform puck 120 can replicate the OEM shape of the underplatform, or incorporate improved cooling and/or strengthening features such as chevron-shaped turbulators 300, a multiple of ribs 400 (FIG. 10), a multiple of dimples 500 (FIG. 11) or other such features. The features facilitate turbulation of a cooling airflow to further control the thermal effects on the turbine blade 84.

The method 200 provides a repair to a small portion of the component to increase platform thickness with the remainder being identical to an OEM component. The Reverse EDM also facilitates a relatively rapid repair.

Figure 12:
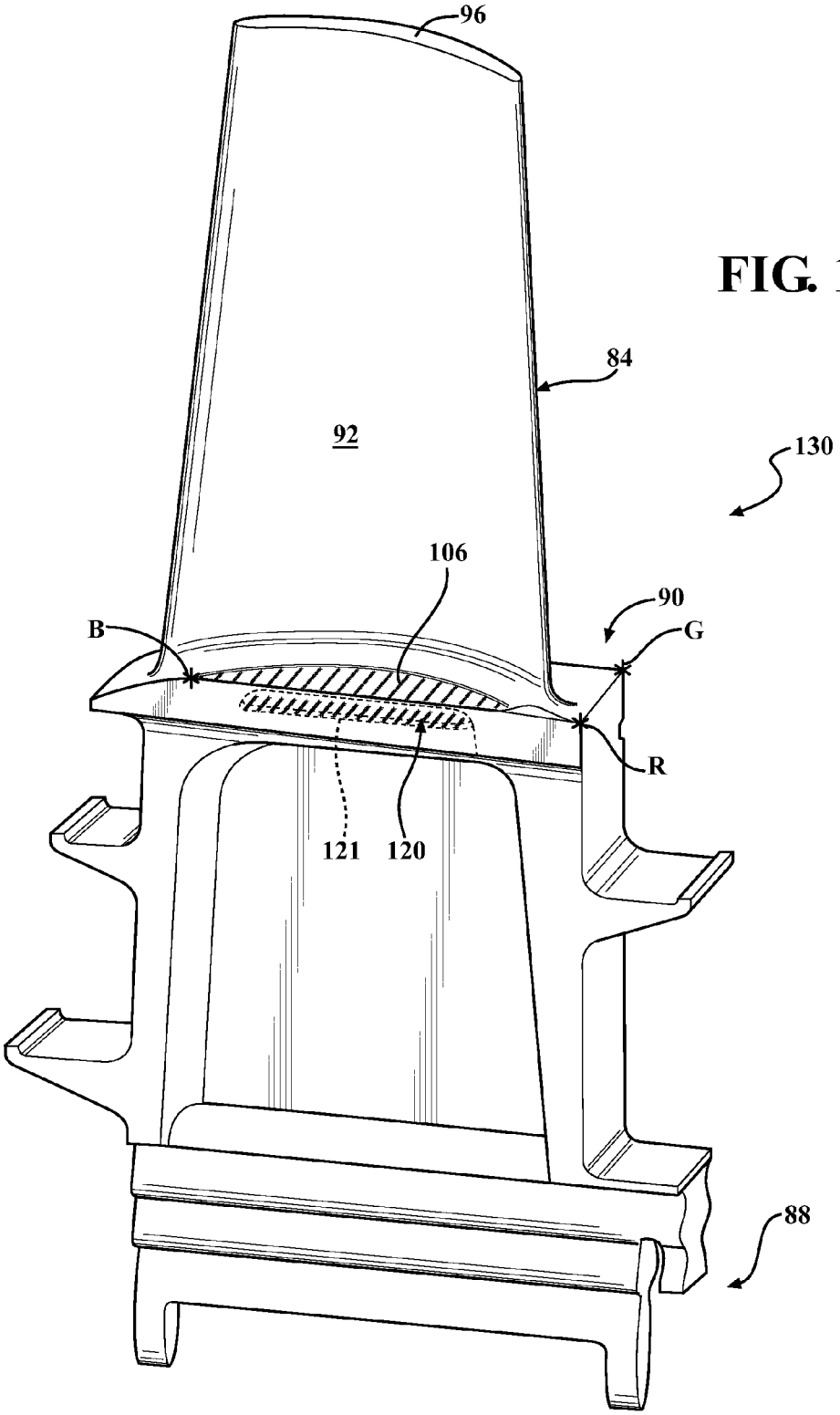
FIG. 12 is a perspective view of an underplatform region of the turbine blade with a puck with a coordinate system located thereon.

With reference to FIG. 12, to define the coordinate values of the platform puck 120 and at least a portion of the platform 90, a unique set of loci, or coordinates in space are provided as Table 1. This unique set of coordinates define a repair assembly 130 including the blade 84 and puck 120. The repair assembly 130 includes the requirements of the close-fitting interface to facilitate a high strength brazed interface with a thickness contemplated to reduce thermal-mechanical fatigue cracks of the platform 90. The set of coordinates are determined by mathematical calculation and modeling of the remanufactured platform puck 120 as brazed to the underplatform 110 as described above.

The coordinate values given in TABLE 1 provide the nominal profile envelope for the repair assembly 130 including an exemplary platform puck 120 and at least a portion of the platform 90 of the blade 84. The portion of the platform 90 of the blade 84 generally includes at least a portion of the gas path surface 106 of the platform 90 and an undersurface 121 of the platform puck 120. That is, at least the gas path surface 106 and its relative Z-position with respect to the undersurface 121 of the platform puck 120 are included within the unique set of loci provided in TABLE 1. It should be appreciated that the portion of the platform 90 given in TABLE 1 may be of various sizes but generally encompasses at least a portion of the gas path surface 91 that is greater than the area of the platform puck 120 brazed to the underplatform 110 as described above and generally exclude fillet regions of the platform 90 that blends to the airfoil 92.

The TABLE 1 values below are generated and shown for determining the profile of the repair assembly 130 including the platform puck 120 and at least a portion of the platform 90. There are typical manufacturing tolerances as well as coatings, which should be accounted for in the actual profile of the platform puck 120 and at least a portion of the platform 90 within the repair assembly 130. Accordingly, the values for the profile given are for a nominal platform puck 120 and at least a portion of the platform 90. It will be appreciated that typical manufacturing tolerances, including any coating thicknesses, may bracket (are additive to, and subtractive from) the X, Y, and Z values. That is, a distance of about +/−0.160 inches in a direction normal to any location along the platform puck 120 and the at least a portion of the platform 90 defines a profile envelope therefor. For the most part, the puck 120 is generally XY oriented puck. In other words, a distance of about +/−0.160 inches in a direction normal to the surface corresponding to any coordinate defines a range of variation between measured coordinates on the actual surface at nominal temperature and ideal position of those coordinates, at the same temperature, as embodied by the invention.

A Cartesian coordinate system of X, Y and Z values given in TABLE 1 below defines a profile of the repair assembly 130 including the platform puck 120 and at least a portion of the platform 90. The coordinate values for the X, Y and Z coordinates are set forth in inches, although other units of dimensions may be used when the values are appropriately converted. The Cartesian coordinate system has orthogonally-related X, Y and Z axes. A positive X coordinate value extends tangentially in the direction of rotation of the rotor. The Y-axis lies parallel to the engine centerline, such as the rotary axis. A positive Y coordinate value is axial forward. A positive Z coordinate value is directed radially outward toward the static casing of the engine 20.

By defining X and Y coordinate values at selected locations in a Z direction normal to the X, Y plane, the profile of the repair assembly 130 including the platform puck 120 and at least a portion of the platform 90 are ascertained. These values represent the platform puck 120 and at least a portion of the platform 90 at ambient, non-operating conditions and are for an uncoated airfoil. Further, in this disclosed non-limiting embodiment, a reference Z-plane at 0, 0, 0 is defined by coordinate s R, B, G. The TABLE 1 values are thereby referenced with respect to the coordinate s R, B, G are:

R: X=0; Y=0; Z=0;

B: X=0; Y=4.375; Z=0; and

G: X=2.643; Y=0.734; Z=0

In this particular reference system, coordinate R is identified as an origin and is essentially located at an aft, pressure side corner, on the gas path side 91 of the platform 90. It should be appreciated that various other reference frames may be defined such that an equivalent Table for the X, Y, and Z coordinates may be correspondingly developed.

The X, Y and Z values given in the TABLE 1 below define a profile of the repair assembly 130 including the platform puck 120 and at least a portion of the platform 90 at various locations thereon. For example, the platform puck 120 and at least a portion of the platform 90, defined by the coordinate system of X, Y and Z values given in the TABLE 1 define a profile of the repair assembly 130 including the platform 90 as repaired with the puck 120 which has been EDM machined and brazed in place.

TABLE 1

| ID | X | Y | Z |
|---|---|---|---|
| 1 | 0.238882 | 2.985783 | 0.033189 |
| 2 | 0.105402 | 3.134299 | 0.033083 |
| 3 | 0.28676 | 2.813484 | 0.032453 |
| 4 | 0.997067 | 3.511551 | −0.23231 |
| 5 | 0.892972 | 3.614059 | −0.23045 |
| 6 | 0.800378 | 2.956205 | 0.033441 |
| 7 | 0.694472 | 3.669181 | 0.03587 |
| 8 | 0.352063 | 3.574031 | 0.03676 |
| 9 | 0.067681 | 2.938217 | 0.031311 |
| 10 | 0.095252 | 3.502677 | 0.035394 |
| 11 | 0.754972 | 3.838583 | −0.22808 |
| 12 | 0.029961 | 2.742142 | 0.02935 |
| 13 | 1.101161 | 3.409043 | −0.23416 |
| 14 | 0.971575 | 3.00378 | 0.03222 |
| 15 | 0.619024 | 3.277012 | 0.035228 |
| 16 | 0.389791 | 3.770114 | 0.037563 |
| 17 | 0.341913 | 3.942413 | 0.038299 |
| 18 | 0.075909 | 4.236224 | 0.023 |
| 19 | 0.249035 | 2.617406 | 0.030878 |
| 20 | 0.859067 | 3.736075 | −0.22993 |
| 21 | 0.485543 | 3.42552 | 0.036091 |
| 22 | 0.88598 | 2.979992 | 0.032925 |

TABLE 1-continued

| ID | X | Y | Z |
|---|---|---|---|
| 23 | 1.009291 | 3.199866 | 0.032055 |
| 24 | 0.60887 | 3.645394 | 0.036382 |
| 25 | 0.963161 | 3.633567 | −0.23179 |
| 26 | 0.276606 | 3.181866 | 0.034571 |
| 27 | 0.427516 | 3.966201 | 0.038173 |
| 28 | 0.848256 | 2.783906 | 0.032705 |
| 29 | 0.742346 | 3.496886 | 0.035134 |
| 30 | 0.00965 | 3.478894 | 0.034555 |
| 31 | 0.201157 | 2.789701 | 0.03161 |
| 32 | 1.067256 | 3.531059 | −0.23364 |
| 33 | 1.019453 | 2.831484 | 0.031484 |
| 34 | 0.666902 | 3.104713 | 0.034492 |
| 35 | 0.437665 | 3.597819 | 0.036827 |
| 36 | 0.838102 | 3.152287 | 0.033661 |
| 37 | 0.170705 | 3.894839 | 0.037969 |
| 38 | 0.143126 | 3.330378 | 0.034657 |
| 39 | 0.560996 | 3.817689 | 0.037118 |
| 40 | 0.324484 | 3.009567 | 0.033835 |
| 41 | 0.656748 | 3.473094 | 0.035646 |
| 42 | 0.543571 | 2.884843 | 0.033815 |
| 43 | 0.208433 | 4.090925 | 0.038965 |
| 44 | 0.362213 | 3.20565 | 0.035028 |
| 45 | 0.047374 | 3.674972 | 0.03613 |
| 46 | 0.077839 | 2.569843 | 0.028614 |
| 47 | 0.875823 | 3.348374 | 0.033693 |
| 48 | 0.475394 | 3.793902 | 0.037437 |
| 49 | 0.495693 | 3.057138 | 0.034551 |
| 50 | 0.122827 | 4.067138 | 0.038705 |
| 51 | 0.961413 | 3.372161 | 0.032791 |
| 52 | 0.71478 | 2.932417 | 0.03376 |
| 53 | 0.677051 | 2.736331 | 0.03315 |
| 54 | 0.399941 | 3.401732 | 0.036024 |
| 55 | 0.218583 | 3.722543 | 0.037232 |
| 56 | 0.115559 | 2.765921 | 0.030575 |
| 57 | 0.085098 | 3.871055 | 0.037516 |
| 58 | −0.0005 | 3.847272 | 0.036866 |
| 59 | 1.057169 | 3.027567 | 0.031323 |
| 60 | 0.704626 | 3.300799 | 0.034909 |
| 61 | 0.591449 | 2.712543 | 0.033083 |
| 62 | 0.256307 | 3.918626 | 0.038228 |
| 63 | 0.933854 | 2.807693 | 0.032193 |
| 64 | 0.372362 | 2.837272 | 0.033102 |
| 65 | 0.037224 | 4.04335 | 0.038252 |
| 66 | 0.132976 | 3.698756 | 0.03678 |
| 67 | 1.168972 | 3.165008 | −0.2352 |
| 68 | 0.827945 | 3.520673 | 0.034429 |
| 69 | 1.105047 | 2.855272 | 0.030587 |
| 70 | 0.180854 | 3.526461 | 0.036043 |
| 71 | 0.447815 | 3.229437 | 0.035287 |
| 72 | 0.457969 | 2.861055 | 0.033555 |
| 73 | 0.266457 | 3.550244 | 0.036496 |
| 74 | 0.15328 | 2.962 | 0.032346 |
| 75 | 1.030972 | 3.389531 | −0.23283 |
| 76 | 0.228732 | 3.354161 | 0.035307 |
| 77 | 0.523272 | 3.621606 | 0.036701 |
| 78 | 0.581299 | 3.080925 | 0.034618 |
| 79 | 0.752504 | 3.1285 | 0.034173 |
| 80 | 0.304185 | 3.746327 | 0.037496 |
| 81 | 0.410091 | 3.033354 | 0.034291 |
| 82 | 0.42024 | 2.664972 | 0.032366 |
| 83 | 0.163433 | 2.593622 | 0.029843 |
| 84 | 0.019803 | 3.110516 | 0.032047 |
| 85 | 1.135067 | 3.287024 | −0.23468 |
| 86 | 0.923697 | 3.176079 | 0.032957 |
| 87 | 0.571146 | 3.449307 | 0.035965 |
| 88 | 0.629173 | 2.90863 | 0.033886 |
| 89 | 0.191004 | 3.158079 | 0.033925 |
| 90 | 0.057528 | 3.306594 | 0.033819 |
| 91 | 0.334638 | 2.641189 | 0.031717 |
| 92 | 0.762654 | 2.760118 | 0.033024 |
| 93 | 0.533421 | 3.253224 | 0.035354 |
| 94 | 0.790224 | 3.324587 | 0.034398 |
| 95 | 0.505843 | 2.688756 | 0.032819 |
| 96 | 0.314335 | 3.377949 | 0.035764 |
| 97 | 0.687201 | 2.367949 | 0.03161 |
| 98 | 0.468118 | 2.492673 | 0.03163 |
| 99 | 0.296909 | 2.445106 | 0.030142 |
| 100 | 0.981732 | 2.635398 | 0.031457 |

TABLE 1-continued

| ID | X | Y | Z |
|---|---|---|---|
| 101 | 0.745228 | 1.827272 | 0.029142 |
| 102 | 0.344787 | 2.272811 | 0.029406 |
| 103 | 0.382512 | 2.46889 | 0.03098 |
| 104 | 0.574024 | 1.779701 | 0.028039 |
| 105 | 0.536295 | 1.583622 | 0.026465 |
| 106 | 0.173591 | 2.225248 | 0.027142 |
| 107 | 0.221469 | 2.052953 | 0.026406 |
| 108 | 0.810531 | 2.587823 | 0.032287 |
| 109 | 0.69735 | 1.999567 | 0.029878 |
| 110 | 0.659626 | 1.803484 | 0.028689 |
| 111 | 0.392665 | 2.100512 | 0.028669 |
| 112 | 0.040122 | 2.373768 | 0.026457 |
| 113 | 0.772807 | 2.391736 | 0.031677 |
| 114 | 0.735079 | 2.195654 | 0.030874 |
| 115 | 0.515992 | 2.320378 | 0.030894 |
| 116 | 0.55372 | 2.516461 | 0.032087 |
| 117 | 0.402819 | 1.732138 | 0.026165 |
| 118 | 0.269346 | 1.880654 | 0.025673 |
| 119 | 0.99189 | 2.267016 | 0.0305 |
| 120 | 0.354941 | 1.904433 | 0.026902 |
| 121 | 0.858409 | 2.415524 | 0.031551 |
| 122 | 0.944012 | 2.439311 | 0.031232 |
| 123 | 0.782957 | 2.023354 | 0.030142 |
| 124 | 0.56387 | 2.148079 | 0.030161 |
| 125 | 0.450697 | 1.559839 | 0.025429 |
| 126 | 0.307067 | 2.076732 | 0.027634 |
| 127 | 1.067331 | 2.659185 | 0.030752 |
| 128 | 0.601598 | 2.344161 | 0.03135 |
| 129 | 0.649476 | 2.171866 | 0.030614 |
| 130 | 0.43039 | 2.296594 | 0.030248 |
| 131 | 0.906287 | 2.243224 | 0.030819 |
| 132 | 0.896134 | 2.61161 | 0.031969 |
| 133 | 0.611748 | 1.975783 | 0.029425 |
| 134 | 0.440543 | 1.928217 | 0.027933 |
| 135 | 0.478268 | 2.124295 | 0.029512 |
| 136 | 0.868559 | 2.047142 | 0.030209 |
| 137 | 0.724929 | 2.564031 | 0.032413 |
| 138 | 0.526146 | 1.952 | 0.028776 |
| 139 | 0.211311 | 2.421327 | 0.029106 |
| 140 | 0.125713 | 2.397547 | 0.027878 |
| 141 | 0.639327 | 2.540248 | 0.032346 |
| 142 | 1.02961 | 2.463098 | 0.03072 |
| 143 | 0.488421 | 1.755917 | 0.027201 |
| 144 | 0.087996 | 2.201469 | 0.02572 |
| 145 | 0.259189 | 2.249028 | 0.02837 |
| 146 | 0.317224 | 1.708358 | 0.024937 |
| 147 | 0.820685 | 2.219437 | 0.030945 |
| 148 | 0.288031 | 2.525819 | −0.21809 |
| 149 | 0.360602 | 2.808874 | −0.21972 |
| 150 | 0.433169 | 3.091929 | −0.22134 |
| 151 | 0.50574 | 3.374984 | −0.22297 |
| 152 | 0.578307 | 3.658035 | −0.2246 |
| 153 | 0.851929 | 2.945441 | −0.22906 |
| 154 | 0.9245 | 3.228496 | −0.23068 |
| 155 | 0.464697 | 2.706366 | −0.22157 |
| 156 | 0.537264 | 2.989421 | −0.2232 |
| 157 | 0.609835 | 3.272476 | −0.22482 |
| 158 | 0.682402 | 3.555528 | −0.22645 |
| 159 | 0.956024 | 2.842933 | −0.23091 |
| 160 | 0.295169 | 3.316453 | −0.21897 |
| 161 | 0.367736 | 3.599508 | −0.22059 |
| 162 | 0.641362 | 2.886913 | −0.22505 |
| 163 | 0.440307 | 3.882563 | −0.22222 |
| 164 | 0.713929 | 3.169969 | −0.22668 |
| 165 | 0.786496 | 3.45302 | −0.22831 |
| 166 | 1.132689 | 3.02348 | −0.23439 |
| 167 | 0.326697 | 2.930894 | −0.2192 |
| 168 | 0.399264 | 3.213945 | −0.22082 |
| 169 | 0.471835 | 3.497 | −0.22245 |
| 170 | 0.745457 | 2.784406 | −0.22691 |
| 171 | 0.544402 | 3.780055 | −0.22407 |
| 172 | 0.818024 | 3.067461 | −0.22854 |
| 173 | 0.890594 | 3.350512 | −0.23016 |
| 174 | 1.236783 | 2.920972 | −0.23624 |
| 175 | 0.358224 | 2.545331 | −0.21943 |
| 176 | 0.430791 | 2.828386 | −0.22105 |
| 177 | 0.503358 | 3.111437 | −0.22268 |
| 178 | 0.575929 | 3.394492 | −0.2243 |

TABLE 1-continued

| ID | X | Y | Z |
|---|---|---|---|
| 179 | 0.648496 | 3.677547 | −0.22593 |
| 180 | 0.922118 | 2.964953 | −0.23039 |
| 181 | 0.994689 | 3.248008 | −0.23202 |
| 182 | 0.534886 | 2.725878 | −0.22291 |
| 183 | 0.607457 | 3.008929 | −0.22453 |
| 184 | 0.680024 | 3.291984 | −0.22616 |
| 185 | 0.752591 | 3.575039 | −0.22778 |
| 186 | 1.026217 | 2.862445 | −0.23224 |
| 187 | 1.098783 | 3.1455 | −0.23387 |
| 188 | 0.292791 | 3.052909 | −0.21868 |
| 189 | 0.365358 | 3.335965 | −0.2203 |
| 190 | 0.437929 | 3.619016 | −0.22193 |
| 191 | 0.711551 | 2.906421 | −0.22639 |
| 192 | 0.510496 | 3.902071 | −0.22356 |
| 193 | 0.784118 | 3.189476 | −0.22801 |
| 194 | 0.856689 | 3.472531 | −0.22964 |
| 195 | 1.202878 | 3.042992 | −0.23572 |
| 196 | 0.324319 | 2.667346 | −0.21891 |
| 197 | 0.396886 | 2.950402 | −0.22053 |
| 198 | 0.469453 | 3.233457 | −0.22216 |
| 199 | 0.542024 | 3.516508 | −0.22378 |
| 200 | 0.815646 | 2.803913 | −0.22824 |
| 201 | 0.614591 | 3.799563 | −0.22541 |
| 202 | 0.888213 | 3.086969 | −0.22987 |
| 203 | 0.960783 | 3.370024 | −0.2315 |
| 204 | 0.428413 | 2.564839 | −0.22076 |
| 205 | 0.50098 | 2.847894 | −0.22239 |
| 206 | 0.573551 | 3.130949 | −0.22401 |
| 207 | 0.646118 | 3.414004 | −0.22564 |
| 208 | 0.718685 | 3.697055 | −0.22726 |
| 209 | 0.992311 | 2.984461 | −0.23172 |
| 210 | 1.064878 | 3.267516 | −0.23335 |
| 211 | 0.331453 | 3.45798 | −0.21978 |
| 212 | 0.605075 | 2.745386 | −0.22424 |
| 213 | 0.40402 | 3.741035 | −0.22141 |
| 214 | 0.677646 | 3.028441 | −0.22587 |
| 215 | 0.750213 | 3.311496 | −0.22749 |
| 216 | 0.822783 | 3.594547 | −0.22912 |
| 217 | 1.096406 | 2.881953 | −0.23358 |
| 218 | 1.028594 | 3.125988 | −0.23254 |
| 219 | 0.290413 | 2.789366 | −0.21838 |
| 220 | 0.36298 | 3.072417 | −0.22001 |
| 221 | 0.435547 | 3.355472 | −0.22164 |
| 222 | 0.508118 | 3.638528 | −0.22326 |
| 223 | 0.78174 | 2.925933 | −0.22772 |
| 224 | 0.580685 | 3.921583 | −0.22489 |
| 225 | 0.854307 | 3.208988 | −0.22935 |
| 226 | 0.926878 | 3.492039 | −0.23097 |
| 227 | 0.394508 | 2.686858 | −0.22024 |
| 228 | 0.467075 | 2.969909 | −0.22187 |
| 229 | 0.539646 | 3.252965 | −0.22349 |
| 230 | 0.612213 | 3.53602 | −0.22512 |
| 231 | 0.885835 | 2.823425 | −0.22957 |
| 232 | 0.68478 | 3.819075 | −0.22674 |
| 233 | 0.958406 | 3.10648 | −0.2312 |
| 234 | 0.333831 | 3.721524 | −0.22007 |
| 235 | 0.498602 | 2.58435 | −0.22209 |
| 236 | 0.297547 | 3.58 | −0.21926 |
| 237 | 0.571169 | 2.867402 | −0.22372 |
| 238 | 0.370114 | 3.863051 | −0.22089 |
| 239 | 0.64374 | 3.150457 | −0.22535 |
| 240 | 0.716307 | 3.433512 | −0.22697 |
| 241 | 0.788878 | 3.716567 | −0.2286 |
| 242 | 1.0625 | 3.003972 | −0.23306 |
| 243 | 0.329075 | 3.194437 | −0.21949 |
| 244 | 0.401642 | 3.477492 | −0.22111 |
| 245 | 0.675268 | 2.764894 | −0.22557 |
| 246 | 0.474213 | 3.760543 | −0.22274 |
| 247 | 0.747835 | 3.047949 | −0.2272 |
| 248 | 0.820402 | 3.331004 | −0.22883 |
| 249 | 1.166594 | 2.901465 | −0.23491 |
| 250 | 0.489087 | 1.530173 | −0.22092 |
| 251 | 0.561657 | 1.813224 | −0.22255 |
| 252 | 0.634224 | 2.09628 | −0.22417 |
| 253 | 0.706791 | 2.379335 | −0.2258 |
| 254 | 0.779362 | 2.66239 | −0.22743 |
| 255 | 1.125551 | 2.232846 | −0.23351 |
| 256 | 1.198122 | 2.515902 | −0.23514 |

TABLE 1-continued

| ID | X | Y | Z |
|---|---|---|---|
| 257 | 1.270689 | 2.798957 | −0.23677 |
| 258 | 0.060453 | 1.637028 | 0.020091 |
| 259 | 0.319559 | 2.14026 | −0.21832 |
| 260 | 0.39213 | 2.423311 | −0.21994 |
| 261 | 0.665752 | 1.710717 | −0.2244 |
| 262 | 0.738319 | 1.993772 | −0.22603 |
| 263 | 0.81089 | 2.276827 | −0.22766 |
| 264 | 0.883457 | 2.559882 | −0.22928 |
| 265 | 0.412976 | 1.36376 | 0.023465 |
| 266 | 0.314803 | 1.613169 | −0.21773 |
| 267 | 0.351087 | 1.754697 | −0.21855 |
| 268 | 0.423654 | 2.037752 | −0.22017 |
| 269 | 0.496224 | 2.320803 | −0.2218 |
| 270 | 0.568791 | 2.603858 | −0.22343 |
| 271 | 0.842413 | 1.891264 | −0.22789 |
| 272 | 0.914984 | 2.174319 | −0.22951 |
| 273 | 0.987551 | 2.457374 | −0.23114 |
| 274 | 1.060122 | 2.740425 | −0.23276 |
| 275 | 0.032929 | 1.072594 | 0.013689 |
| 276 | 0.455181 | 1.652189 | −0.2204 |
| 277 | 0.241791 | 1.316209 | 0.020429 |
| 278 | 0.527752 | 1.935244 | −0.22203 |
| 279 | 0.600319 | 2.218295 | −0.22365 |
| 280 | 0.672886 | 2.50135 | −0.22528 |
| 281 | 1.019079 | 2.071811 | −0.23137 |
| 282 | 1.091646 | 2.354866 | −0.23299 |
| 283 | 1.164217 | 2.637917 | −0.23462 |
| 284 | 0.285654 | 2.262276 | −0.2178 |
| 285 | 0.559276 | 1.549681 | −0.22226 |
| 286 | 0.631846 | 1.832736 | −0.22388 |
| 287 | 0.704413 | 2.115787 | −0.22551 |
| 288 | 0.776984 | 2.398843 | −0.22713 |
| 289 | 0.849551 | 2.681898 | −0.22876 |
| 290 | 0.280898 | 1.735185 | −0.21721 |
| 291 | 0.317181 | 1.876713 | −0.21803 |
| 292 | 0.389748 | 2.159768 | −0.21965 |
| 293 | 0.462319 | 2.442823 | −0.22128 |
| 294 | 0.735941 | 1.730228 | −0.22574 |
| 295 | 0.146039 | 1.660803 | 0.021902 |
| 296 | 0.459941 | 2.17928 | −0.22099 |
| 297 | 0.808508 | 2.013283 | −0.22736 |
| 298 | 0.881079 | 2.296335 | −0.22899 |
| 299 | 0.953646 | 2.57939 | −0.23062 |
| 300 | 0.421276 | 1.774205 | −0.21988 |
| 301 | 0.493846 | 2.05726 | −0.22151 |
| 302 | 0.050283 | 2.005398 | 0.02337 |
| 303 | 0.566413 | 2.340315 | −0.22313 |
| 304 | 0.63898 | 2.62337 | −0.22476 |
| 305 | 0.912606 | 1.910776 | −0.22922 |
| 306 | 0.985173 | 2.193827 | −0.23085 |
| 307 | 1.05774 | 2.476882 | −0.23247 |
| 308 | 1.130311 | 2.759937 | −0.2341 |
| 309 | 0.022752 | 1.440957 | 0.017354 |
| 310 | 0.52537 | 1.671697 | −0.22174 |
| 311 | 0.002409 | 2.177693 | 0.024106 |
| 312 | 0.597941 | 1.954752 | −0.22336 |
| 313 | 0.670508 | 2.237807 | −0.22499 |
| 314 | 0.743079 | 2.520862 | −0.22661 |
| 315 | 1.089268 | 2.091319 | −0.2327 |
| 316 | 1.161839 | 2.374374 | −0.23433 |
| 317 | 1.234406 | 2.657429 | −0.23595 |
| 318 | 0.118504 | 1.096362 | 0.015886 |
| 319 | 0.283276 | 1.998732 | −0.2175 |
| 320 | 0.355843 | 2.281783 | −0.21913 |
| 321 | 0.629469 | 1.569189 | −0.22359 |
| 322 | 0.135874 | 2.029173 | 0.024984 |
| 323 | 0.702035 | 1.852244 | −0.22522 |
| 324 | 0.774602 | 2.135299 | −0.22684 |
| 325 | 0.847173 | 2.418354 | −0.22847 |
| 326 | 0.91974 | 2.701406 | −0.23009 |
| 327 | 0.156209 | 1.292433 | 0.018622 |
| 328 | 0.070626 | 1.268661 | 0.016618 |
| 329 | 0.38737 | 1.896224 | −0.21936 |
| 330 | 0.279508 | 1.51228 | 0.02278 |
| 331 | 0.532508 | 2.462331 | −0.22261 |
| 332 | 0.80613 | 1.749736 | −0.22707 |
| 333 | 0.878701 | 2.032791 | −0.2287 |
| 334 | 0.951268 | 2.315846 | −0.23032 |

TABLE 1-continued

| ID | X | Y | Z |
|---|---|---|---|
| 335 | 1.023835 | 2.598898 | −0.23195 |
| 336 | 0.012575 | 1.809327 | 0.020827 |
| 337 | 0.418898 | 1.510661 | −0.21959 |
| 338 | 0.491465 | 1.793717 | −0.22122 |
| 339 | 0.098161 | 1.833098 | 0.022634 |
| 340 | 0.564035 | 2.076772 | −0.22284 |
| 341 | 0.327382 | 1.339984 | 0.022043 |
| 342 | 0.204087 | 1.120134 | 0.017886 |
| 343 | 0.636602 | 2.359823 | −0.22447 |
| 344 | 0.709173 | 2.642878 | −0.22609 |
| 345 | 0.982795 | 1.930283 | −0.23055 |
| 346 | 1.055362 | 2.213339 | −0.23218 |
| 347 | 1.127933 | 2.496394 | −0.23381 |
| 348 | 1.2005 | 2.779445 | −0.23543 |
| 349 | 0.365098 | 1.536059 | 0.024201 |
| 350 | 0.321937 | 2.403803 | −0.21861 |
| 351 | 0.595563 | 1.691209 | −0.22307 |
| 352 | 0.193917 | 1.488504 | 0.021165 |
| 353 | 0.23163 | 1.684579 | 0.023516 |
| 354 | 0.66813 | 1.974264 | −0.2247 |
| 355 | 0.740697 | 2.257315 | −0.22632 |
| 356 | 0.813268 | 2.54037 | −0.22795 |
| 357 | 0.108331 | 1.464728 | 0.019358 |
| 358 | 0.353465 | 2.01824 | −0.21884 |
| 359 | 0.426035 | 2.301295 | −0.22046 |
| 360 | 0.699657 | 1.588701 | −0.22493 |
| 361 | 0.183752 | 1.856874 | 0.024252 |
| 362 | 0.772224 | 1.871756 | −0.22655 |
| 363 | 0.844795 | 2.154807 | −0.22818 |
| 364 | 0.917362 | 2.437862 | −0.2298 |
| 365 | 0.989929 | 2.720917 | −0.23143 |
| 366 | 0.348709 | 1.491154 | −0.21826 |
| 367 | 0.384992 | 1.632677 | −0.21907 |
| 368 | 0.457559 | 1.915732 | −0.22069 |
| 369 | 0.53013 | 2.198787 | −0.22232 |
| 370 | 0.602697 | 2.481843 | −0.22395 |
| 371 | 0.94889 | 2.052299 | −0.23003 |
| 372 | 1.021457 | 2.335354 | −0.23166 |
| 373 | 1.094028 | 2.618409 | −0.23328 |

It will also be appreciated that the exemplary platform puck 120 and at least a portion of the platform 90 disclosed in TABLE 1 may be scaled up or down geometrically for use in other similar turbine blades. Consequently, the coordinate values set forth in the TABLE 1 may be scaled upwardly or downwardly such that the profile shape of the platform puck 120 and at least a portion of the platform 90 remains generally unchanged. For example, a scaled version of the coordinates in TABLE 1 would be represented by the X, Y and Z coordinates of TABLE 1 multiplied or divided by a constant.

Figure 13:
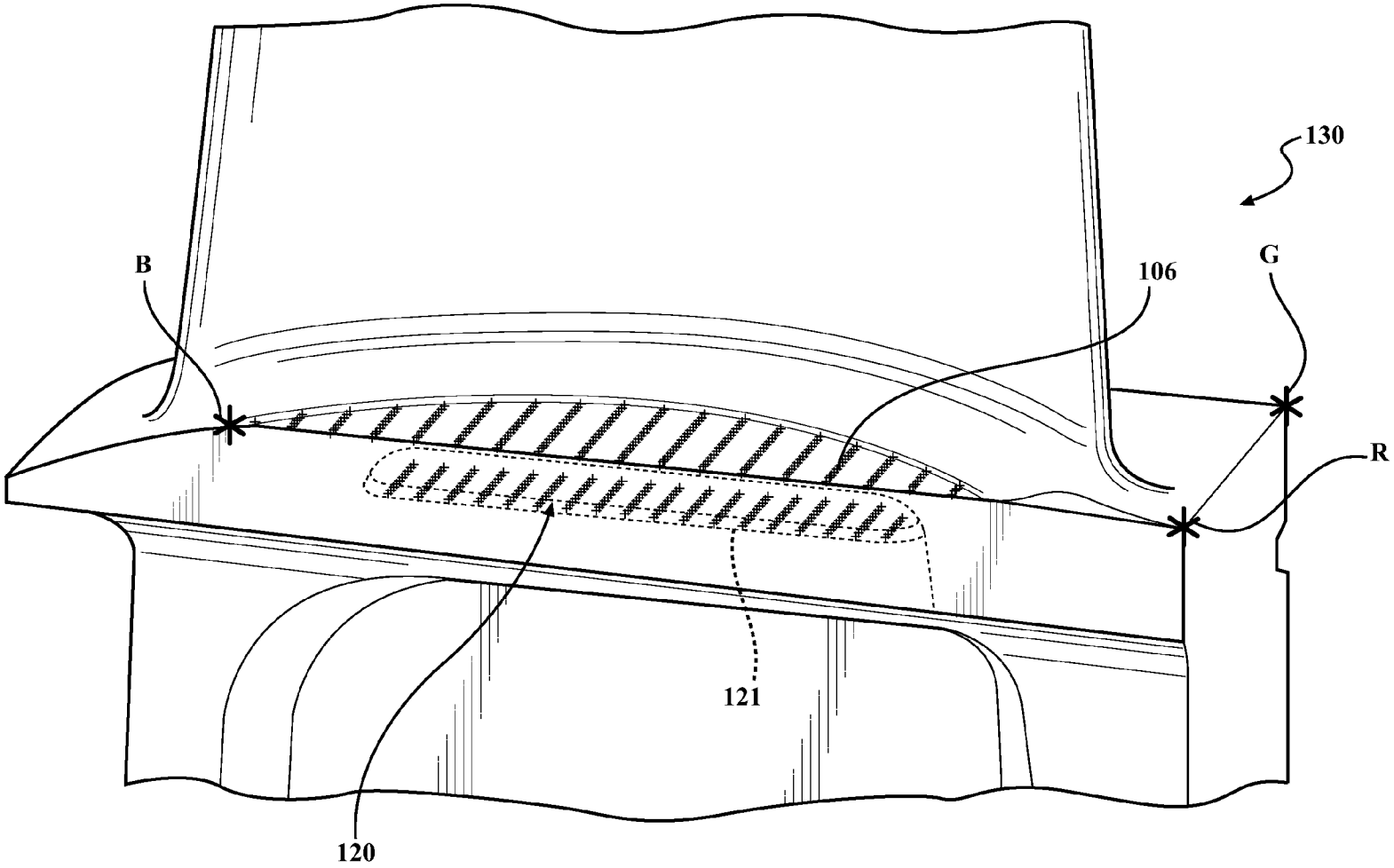
FIG. 13 is a perspective view of an underplatform region of the turbine blade with a puck with a coordinate system located thereon.

Further, for example, the Z coordinate values of TABLE 1 may be multiplied or divided by a constant to accommodate thickness variations between the gas path surface 91 and a bottom surface 121 of the platform puck 120 (FIG. 13) with a platform puck 120 having a thickness of about 0.030"-0.375" (0.762-9.525 mm).

The use of the terms "a," "an," "the," and similar are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. An article of manufacture, the article having a nominal profile substantially in accordance with Cartesian coordinate values of X, Y and Z set forth in TABLE 1, and wherein X and Y are distances in inches which, when connected by smooth continuing arcs, define profile sections at each distance Z in inches to form a portion of a rotor blade.

2. The article of manufacture as recited in claim 1, wherein the portion of said rotor blade is a platform puck and a portion of a platform.

3. The article of manufacture as recited in claim 2, wherein said platform puck is electrical discharge machined.

4. The article of manufacture as recited in claim 3, wherein said platform puck is brazed to said platform.

5. The article of manufacture as recited in claim 4, wherein said platform puck and said portion of a platform lies in an envelope within +/−.0.160 inches in a direction normal to any article surface location.

6. The article of manufacture as recited in claim 1, wherein said nominal profile lies in an envelope within +/−.0.160 inches in a direction normal to any article surface location.

7. The article of manufacture as recited in claim 1, wherein the Cartesian coordinate values of X, Y and Z set forth in TABLE 1 are scaled by a constant to provide a scaled-up or scaled-down profile.

8. The article of manufacture as recited in claim 7, wherein said nominal profile lies in an envelope within +/−.0.160 inches in a direction normal to any article surface location.

9. The article of manufacture as recited in claim 1, wherein the Cartesian coordinate values of Z set forth in TABLE 1 are scaled by a constant to provide a scaled-up or scaled-down profile.

10. A rotor blade having a nominal profile substantially in accordance with Cartesian coordinate values of X, Y and Z set forth in TABLE 1, and wherein X and Y are distances in inches which, when connected by smooth continuing arcs, define profile sections at each distance Z in inches to form a platform puck brazed to a portion of a platform.

11. The rotor blade as recited in claim 10, wherein said platform puck is electrical discharge machined.

12. The rotor blade as recited in claim 11, wherein said platform puck is brazed to said platform.

13. The rotor blade as recited in claim 12, wherein said platform puck and said portion of a platform lies in an envelope within +/−.0.160 inches in a direction normal to any article surface location.

14. The rotor blade as recited in claim 12, wherein the Cartesian coordinate values of X, Y and Z set forth in TABLE 1 are scaled by a constant to provide a scaled-up or scaled-down profile.

15. The rotor blade as recited in claim 12, wherein the Cartesian coordinate values of Z set forth in TABLE 1 are scaled by a constant to provide a scaled-up or scaled-down profile.

16. A rotor blade having a nominal profile substantially in accordance with Cartesian coordinate values of X, Y and Z set forth in TABLE 1, wherein X and Y are distances in inches which, when connected by smooth continuing arcs, define profile sections at each distance Z in inches to form a platform puck brazed to a portion of a platform, the Cartesian coordinate values of X, Y and Z set forth in TABLE 1 are scaled by a constant to provide a scaled-up or scaled-down profile.

17. The rotor blade as recited in claim 16, wherein said platform puck is electrical discharge machined.

18. The rotor blade as recited in claim 16, wherein said platform puck is brazed to said platform.

19. The rotor blade as recited in claim 16, wherein said platform puck is brazed to said platform only on a pressure side of said platform.

20. The rotor blade as recited in claim 16, wherein said platform puck and said portion of a platform lies in an envelope within +/−.0.160 inches in a direction normal to any article surface location.

* * * * *